US005717391A

United States Patent [19]

Rodriguez

[11] Patent Number: 5,717,391

[45] Date of Patent: Feb. 10, 1998

[54] TRAFFIC EVENT RECORDING METHOD AND APPARATUS

[76] Inventor: Otto M. Rodriguez, 5708 Lost Grove Dr., Lilburn, Ga. 30247

[21] Appl. No.: 800,109

[22] Filed: Feb. 13, 1997

[51] Int. Cl.[6] ..... G08G 1/017

[52] U.S. Cl. ..... 340/937; 340/907; 340/916; 340/902; 340/903; 340/905

[58] Field of Search ..... 340/937, 907, 340/909, 915, 916, 917, 902, 903, 904, 905

[56] References Cited

U.S. PATENT DOCUMENTS 3,582,620 6/1971 Noetinger ..... 340/934
4,023,017 5/1977 Ceseri ..... 340/905
4,241,326 12/1980 Odom ..... 340/933
4,578,665 3/1986 Yang ..... 340/539
4,638,289 1/1987 Zottnik ..... 340/436

*Primary Examiner*—Thomas Mullen
*Assistant Examiner*—Nina Tong
*Attorney, Agent, or Firm*—James B. Middleton

[57] ABSTRACT

A system for determining the condition of a traffic controlling semaphore has an audio sensor mounted in the vicinity of an intersection so the sound level is monitored at all times. A computer is placed into the semaphore controller, and the computer receives the audio signal, a time signal, and a signal representing the status of the semaphore. When a sound is detected above a certain minimum level, which is above the usual traffic noise, a record is generated by the computer, and recorded in permanent form, perhaps printed on paper. The record includes the date, time, and status of the semaphore.

7 Claims, 2 Drawing Sheets

TRAFFIC EVENT RECORDING METHOD AND APPARATUS

BACKGROUND OF THE INVENTION

1. Field of the Invention

This invention relates generally to traffic control or the like, and is more particularly concerned with a method and apparatus for monitoring and recording the condition of a traffic controlling semaphore device at the time of a collision.

2. Discussion of the Prior Art

Traffic controlling semaphore devices, or traffic lights, are commonly used to control traffic at an intersection. The idea is of course that those having a red light stop, and those having a green light pass through the intersection. This has been somewhat complicated by the right-turn-on-red laws, but it is still generally true that the one with the green light has the right-of-way and the one with the red light must yield.

In spite of the rules well enunciated, it is not infrequent that there is a collision at an intersections controlled by a semaphore device. When there is a collision, one of the important questions is, Who had the green light? The vehicle that should have stopped for the red light is guilty of a traffic law violation, and of course may be the cause of the collision. To determine the condition of the semaphore device at the time of the collision, one must rely on the reports of the people involved in the collision, and on any other witnesses who may have seen the collision. All of these sources are unreliable, the third-party witnesses having too little interest to be attentive and trustworthy, and the involved parties having too much personal interest to be objective.

Thus, the prior art has not provided a means for determining the condition of a semaphore device at the time of a collision, to assist in determining fault.

SUMMARY OF THE INVENTION

The present invention provides an audio sensor disposed in the vicinity of an intersection controlled by a semaphore device. The audio sensor detects sounds loud enough that they may indicate an automobile collision; and, when a "loud event" is detected, the date, time and semaphore condition are recorded on a permanent record. The magnitude of the loud event will of course be set to exclude the usual traffic noise, but to include collisions that occur generally within the intersection being monitored.

Semaphore devices presently include a control box in the area of the intersection. The control box provides the timing, switching and controls necessary to provide power to the proper lights at the proper times. As a result, a signal indicating the condition of the semaphore device is already available, and this signal is fed to a micro processing unit, along with the audio signal. A printer or other permanent recording means is provided, and the conditions are recorded each time a loud event is detected by the audio sensor.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
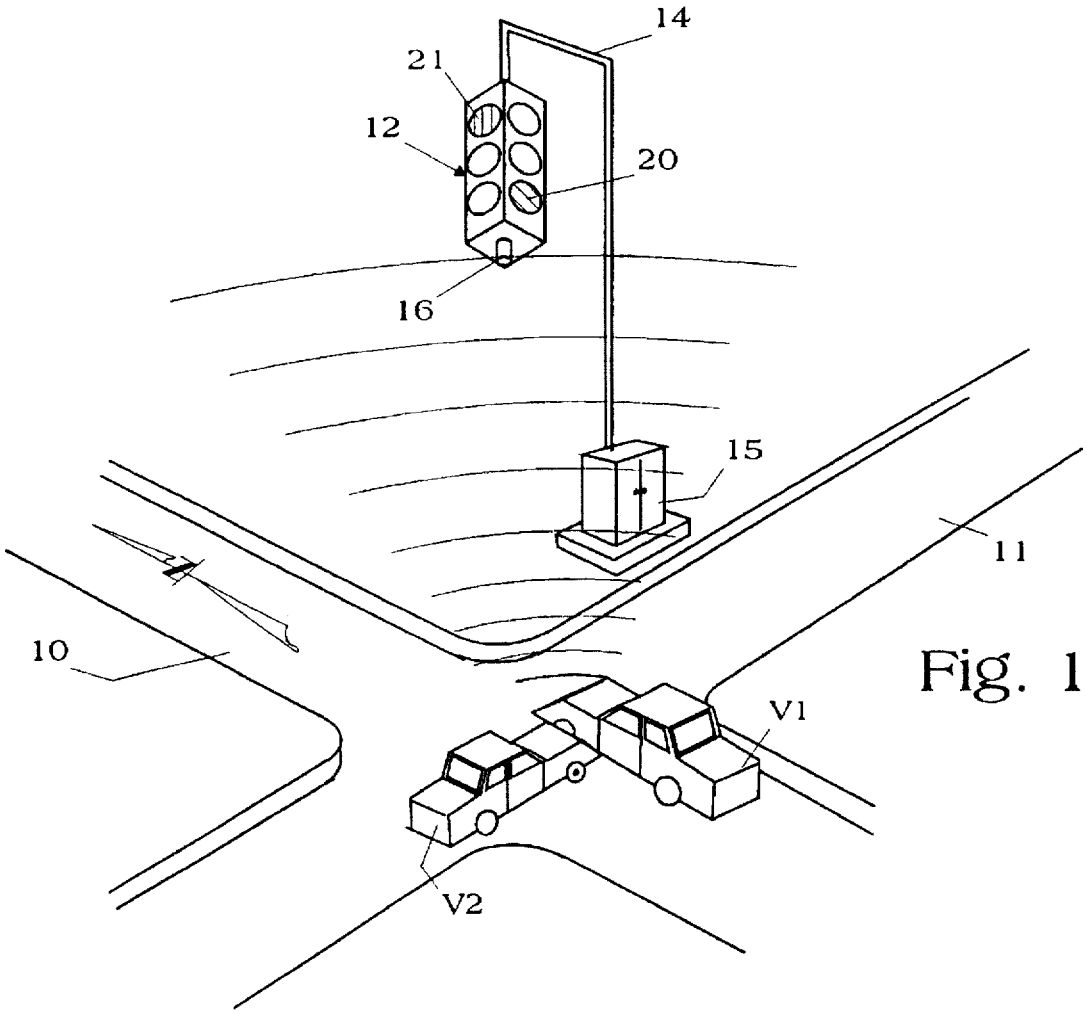
FIG. 1 is a perspective view showing an intersection controlled by a semaphore device, and including the apparatus of the present invention.

Referring now more particularly to the drawings, and to that embodiment of the invention here presented by way of illustration, FIG. 1 illustrates an intersection of two streets: a north-south street 10 and an east-west street 11. A semaphore, or traffic light 12 is disposed above the intersection. While not here illustrated, it will be understood that the semaphore 12 may be suspended from a pole having an arm extending over the intersection, or may be held by cables passing diagonally over the intersection. Such arrangements are well known in the art and do not need to be disclosed in any detail.

From the semaphore 12, there is an electrical cable 14 extending to a control box 15. Those skilled in the art will understand that the control box 15 includes control circuitry, timers, switches and the like to determine which lights in the semaphore are on, when, and for how long. The appropriate signals are then sent along the cable 14 to the semaphore 12.

It will be noticed in FIG. 1 that there is an audio sensor 16 carried at the bottom of the semaphore 12. Appropriate wires connected to the sensor 16 will preferably be included in the cable 14, though it will be readily understood that the communication of the sensor 16 with other apparatus to be discussed may be by radio waves or the like if desired. Such technology is well known, and can easily be substituted for wires in the cable 14.

With the foregoing description in mind the general operation of the present invention should be understood. When two or more vehicles collide in the vicinity of the intersection, such as vehicles V1 and V2, the sound generated by the collision will constitute a loud event, and will be detected by the sensor 16. A signal from the sensor 16 will be sent to the control box 15 where a date and time stamp will be applied, along with the condition of the semaphore 12 at the time of the loud event.

Figure 2:
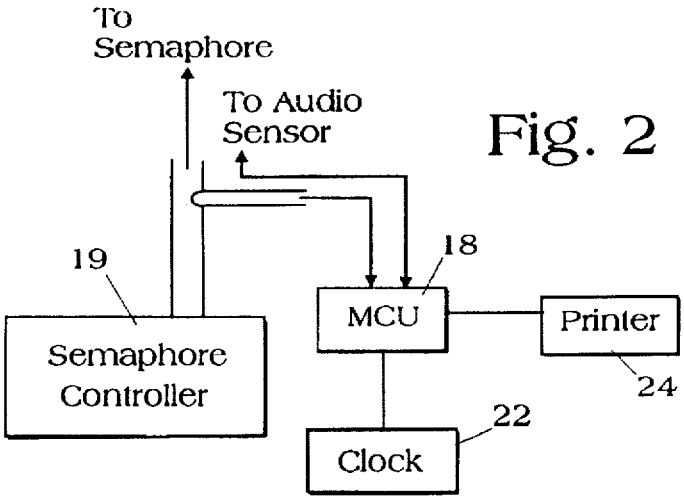
FIG. 2 is a schematic diagram illustrating the connection of the apparatus of the present invention to the existing semaphore controller.

With attention directed to FIGS. 1 and 2, it will be seen that there is a microcomputer or the like 18, preferably mounted within the control box 15. The semaphore controller 19 will output a signal to illuminate each light in the semaphore 12, for example the green light 20 for the north-south street 10 and the red 21 for the east-west street 11. These signals are also directed to the microcomputer 18, so the computer 18 knows at all times the condition of the semaphore device 12. The input from the audio sensor 16 is also directed to the computer 18.

A clock or the like 22 is shown as providing another input to the computer 18. It will be understood that many computers have a clock built in, and such a clock may be used; but, a clock is required, whether separate or integral. The "clock" will maintain the date and time, time being on a 24 hour basis.

A permanent recording means 24 receives the output from the computer 18. While the recording means 24 is here indicated as a printer, those skilled in the art will realize that other recording means may be used. For example, a magnetic recording means such as a tape, disk or the like can be used, or electronic memory may be used so long as a battery is provided to hold the data and prevent loss.

Figure 3:
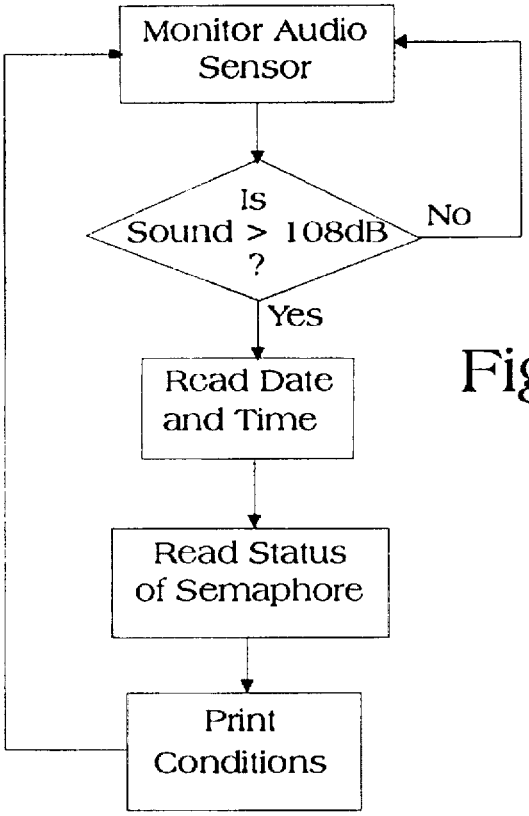
FIG. 3 is a schematic diagram showing the logic for use in the microprocessor in accordance with the present invention; and, FIG. 4 shows a recording means for use with the present invention.

Looking at FIG. 3 of the drawings, then, the computer 18 will constantly monitor input from the audio sensor 16. Obviously there will be frequent sounds received by the sensor 16; but, not all the sounds will be collisions. In an effort to separate collisions from other sounds, a minimum decibel level may be required to define the "loud event". A particular level can be set based on experience, and perhaps varied depending on location. By way of example, however, an automobile horn may be up to 108 dB; therefore, a "loud event" may be defined as a sound above 108 dB. As a result, in FIG. 3 the first query on receiving input from the sensor 16 is whether the sound is a loud event. If the answer is No, no further action is taken, and monitoring is continued.

If the sound received is a loud event as defined for the particular system, there is a good chance that there was a collision in the intersection to create the sound, so the date and time are read from the clock 22, and the status of the semaphore device 12 is read. All this information then goes to the recording means 24. Once the information is recorded, the system returns to monitoring the audio sensor. If desired, there may be a time delay between the printing and the return to monitoring.

Figure 4:
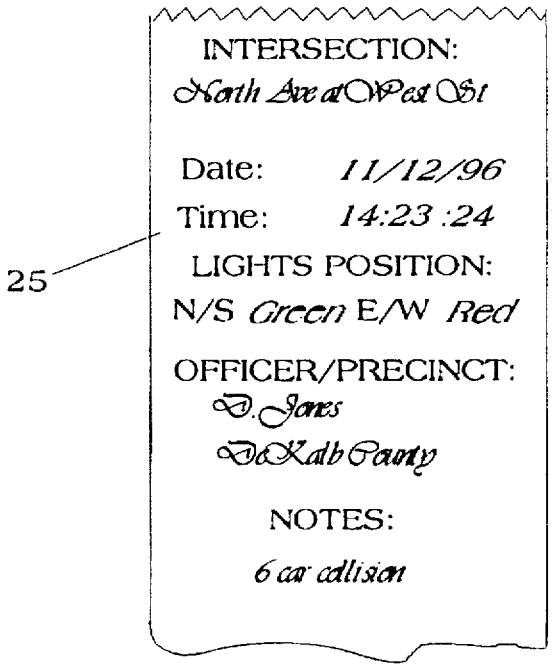

FIG. 4 illustrates one form of output that may be used for the system of the present invention. This output again assumes that the recording means 24 is a printer, and a length of paper or the like is shown at 25. For convenience, the writing in normal letters will be pre-programmed and not changeable. The italicized writing indicates the variables that are printed, and the script indicates material written by the investigating officer.

Thus, the first line states "Intersection", and a description is filled in by the officer. next the date and time are filled in automatically; and, the condition of the semaphore is filled in automatically. A space is provided for the officer to sign and give the precinct or other jurisdictional area; and finally there is a place for additional comments or notes. In the example, the officer has indicated there was a 6-car collision. Only the first collision would be recorded by the system if the collisions were very close in time; but, if additional cars collide later, such events may be recorded.

It will be understood by those skilled in the art that the present invention provides a method and apparatus for determining the vehicle at fault in the semaphore controlled intersection. When a collision occurs, the sound waves indicated at 26 in FIG. 1 will radiate upwardly; and, if the collision is close enough to the intersection, the audio sensor 16 will detect the sound. Due to the intensity level requirement, a collision much removed from the intersection will not be recorded as a loud event; but, when the collision is close enough, the event will be detected, and the date, time and semaphore status will be accurately recorded. It can therefore be determined which vehicle ought to have stopped, and which had the right-of-way. The easy decision on such matters can virtually eliminate the arguments in prosecuting traffic violations, and also render civil actions easier to resolve since the person at fault is quickly determined. In the face of such evidence, the insurance companies that represent the vehicles involved can determine liability without a lengthy inquiry.

While the embodiment of the invention here illustrated is in an intersection of two streets, it will be understood that the invention is equally applicable to other intersections, whether having more or fewer streets. The controller will include signals for each set of lights, regardless of the number of sets, so the system will be the same as is here illustrated, but with more or fewer streets to be designated.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A method for determining the condition of a traffic controlling semaphore at a street intersection at the time of a collision in said intersection, said semaphore including a controller, said method comprising the steps of placing an audio sensor in the vicinity of said intersection, providing computing means within said controller, providing clock means within said controller, feeding audio signals from said audio sensor to said computing means, monitoring said audio signals for sounds above a minimum decibel level that constitutes a loud event, feeding semaphore controlling signals to said computing means, creating a record at the time of each loud event, said record comprising status of said semaphore, date and time, and recording said record on a recording means.

2. A method as claimed in claim 1, wherein said minimum decibel level is above the decibel level of the usual traffic noise at said intersection.

3. A method as claimed in claim 1, wherein said minimum decibel level is at least 108 decibels.

4. A method as claimed in claim 1, wherein said step of recording said record comprises printing said record using a printer.

5. Apparatus for determining the condition of a traffic controlling semaphore at a street intersection at the time of a collision in said intersection, said semaphore including a controller for generating signals to control said semaphore, computing means within said controller, clock means within said controller for providing date and time to said computing means, circuit means for providing said signals to control said semaphore to said computing means, an audio sensor in the vicinity of said intersection for providing audio signals to said computing means, means for determining when said audio signals are above a minimum decibel level that constitutes a loud event, means for creating a record at the time of each loud event, said record comprising status of said semaphore, date and time, and recording means for said record.

6. Apparatus as claimed in claim 5, wherein said audio sensor is carried by said semaphore.

7. Apparatus as claimed in claim 5, wherein said recording means comprises a printer.

* * * * *